US009221098B2

(12) United States Patent
Boisdequin et al.

(10) Patent No.: US 9,221,098 B2
(45) **Date of Patent: *Dec. 29, 2015**

(54) INNER NOZZLE FOR TRANSFERRING MOLTEN METAL CONTAINED IN A VESSEL, SYSTEM FOR CLAMPING SAID NOZZLE AND CASTING DEVICE

(75) Inventors: Vincent Boisdequin, Naast (BE); Mariano Collura, Bracquegnies (BE); Fabrice Sibiet, Colleret (FR)

(73) Assignee: VESUVIUS CRUCIBLE COMPANY, Wilmington, DE (US)

( * ) Notice: Subject to any disclaimer, the term of this patent is extended or adjusted under 35 U.S.C. 154(b) by 220 days.

This patent is subject to a terminal disclaimer.

(21) Appl. No.: 13/635,788

(22) PCT Filed: Mar. 17, 2011

(86) PCT No.: PCT/EP2011/001326

§ 371 (c)(1), (2), (4) Date: Sep. 18, 2012

(87) PCT Pub. No.: WO2011/113599

PCT Pub. Date: Sep. 22, 2011

(65) Prior Publication Data

US 2013/0056506 A1 Mar. 7, 2013

(30) Foreign Application Priority Data

Mar. 19, 2010 (EP) ..... 10157126

(51) Int. Cl.

*B22D 41/56* (2006.01)
*B22D 41/34* (2006.01)
*B22D 41/40* (2006.01)

(52) U.S. Cl.

CPC ..... *B22D 41/34* (2013.01); *B22D 41/40* (2013.01); *B22D 41/56* (2013.01); *Y10T 29/53* (2015.01)

(58) Field of Classification Search

CPC ..... B22D 41/28; B22D 41/34
USPC ..... 222/600, 603, 607
See application file for complete search history.

(56) References Cited

U.S. PATENT DOCUMENTS

| | | | | |
|---|---|---|---|---|
| 3,887,117 | A * | 6/1975 | Fehling | 222/600 |
| 4,632,283 | A * | 12/1986 | Arakawa et al. | 222/600 |
| 5,044,533 | A | 9/1991 | King | |
| 5,170,915 | A | 12/1992 | Szadkowski | |
| 5,211,857 | A | 5/1993 | Brinker | |

(Continued)

FOREIGN PATENT DOCUMENTS

| | | | |
|---|---|---|---|
| CN | 1424949 | A | 6/2003 |
| CN | 201201049 | Y | 3/2009 |

(Continued)

*Primary Examiner* — Scott Kastler
(74) *Attorney, Agent, or Firm* — Thomas Clinton; Donald M. Satina

(57) ABSTRACT

A refractory nozzle comprises a substantially tubular portion with an axial through bore and a plate comprising a first, contact surface normal to the axial through bore and comprising the outlet opening, and a second surface opposite to the first contact surface joining the wall of the tubular portion to the side edges defining the perimeter and thickness of the plate. All but the first contact surface of the inner nozzle plate are at least partially clad with a metal casing having side edges. The inner nozzle plate metal casing comprises three separate bearing elements jutting out of the side edges. Each bearing element comprises a bearing ledge facing in the direction of the contact surface and distributed around the perimeter of the plate. The centroids of the orthogonal projections onto a plane parallel to the contact surface of the bearing ledges form the vertices of a triangle.

5 Claims, 6 Drawing Sheets

(56) References Cited

U.S. PATENT DOCUMENTS

| | | | | |
|---|---|---|---|---|
| 8,127,972 | B2 | 3/2012 | Hanse et al. | |
| 2010/0147905 | A1 * | 6/2010 | Keller | 222/600 |
| 2013/0008927 | A1 * | 1/2013 | Boisdequin et al. | 222/591 |

FOREIGN PATENT DOCUMENTS

| | | | |
|---|---|---|---|
| DE | 9408700 | U1 | 9/1994 |
| DE | 202005017531 | U1 | 2/2006 |
| EP | 0122904 | A2 | 10/1984 |
| EP | 1289696 | B1 | 5/2005 |
| FR | 2707190 | A3 | 1/1995 |
| JP | 07116825 | A | 5/1995 |
| WO | 91/03339 | A1 | 3/1991 |
| WO | 01/81028 | A1 | 11/2001 |
| WO | WO 2008071327 | A1 * | 6/2008 |

* cited by examiner

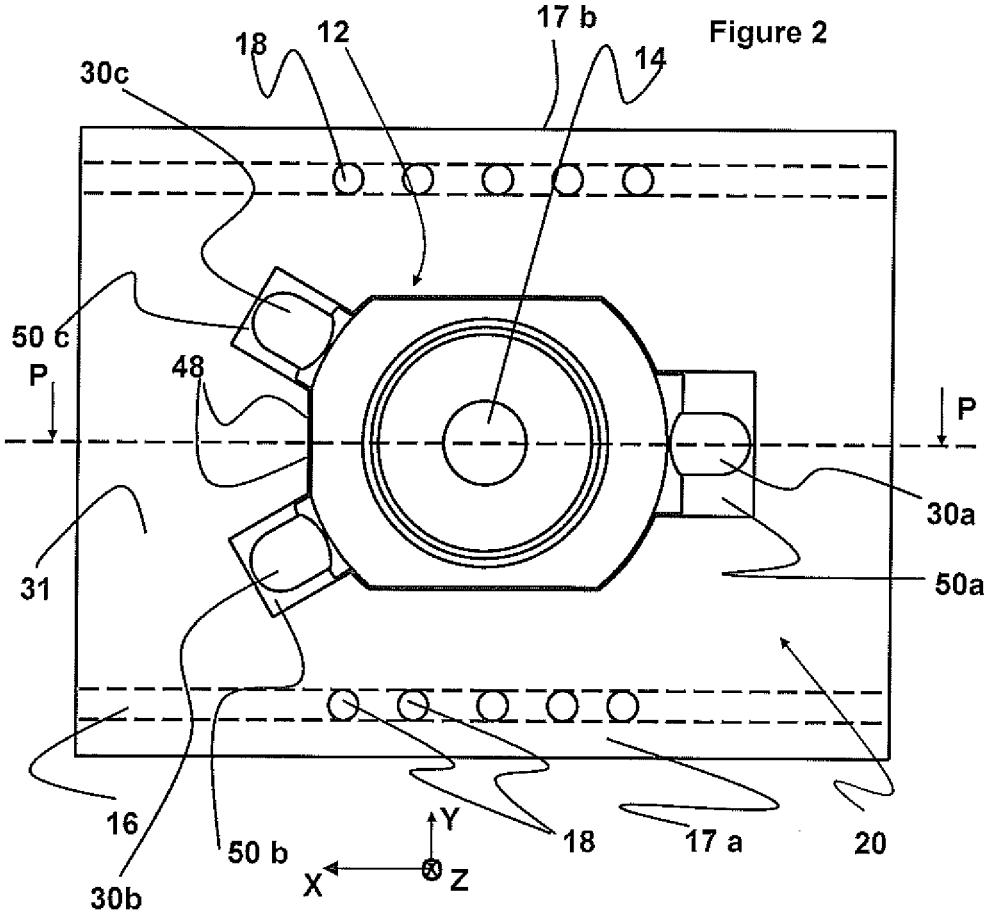
Figure 2 a
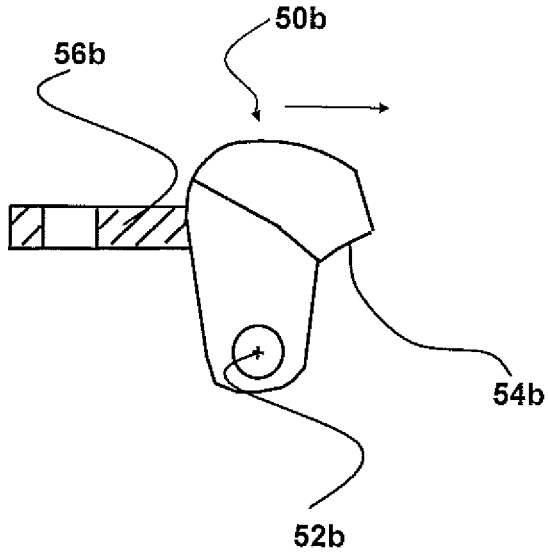

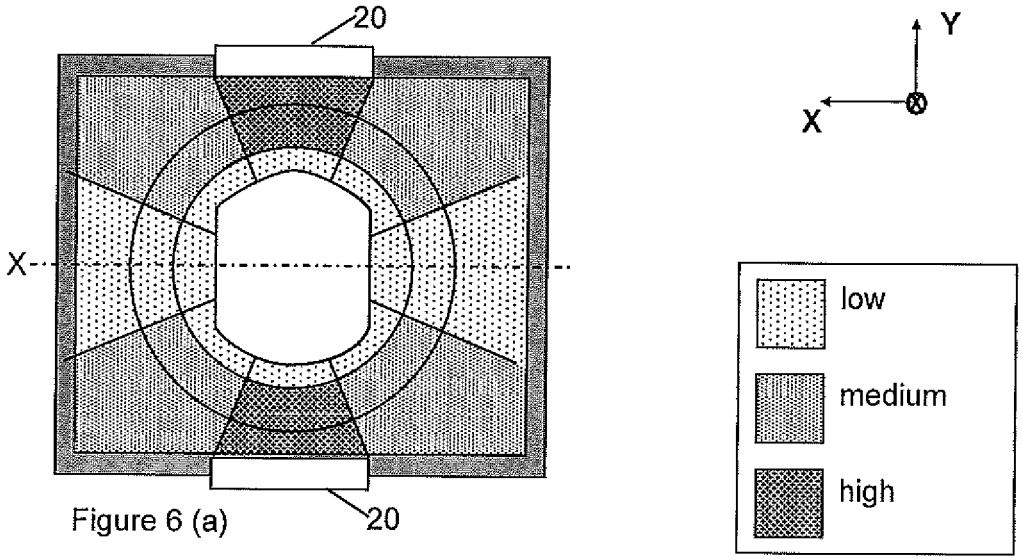
Figure 6 (a)
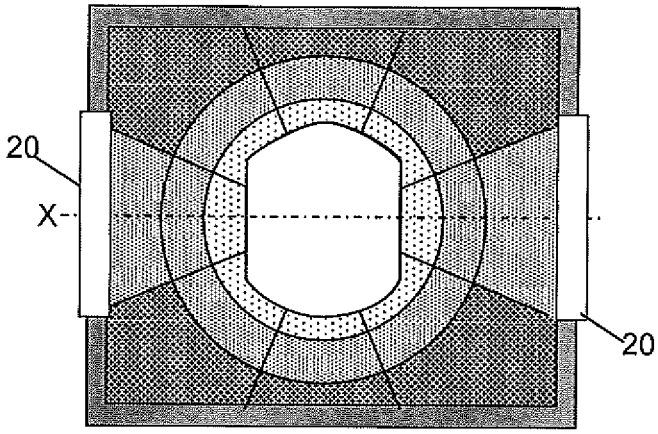
Figure 6 (b)
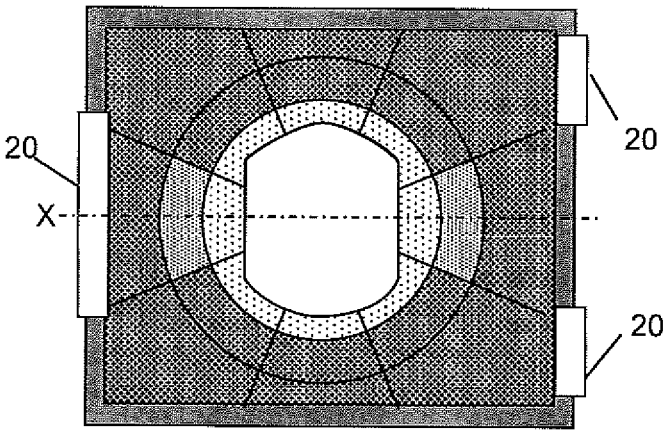
Figure 6 (c)
Figure 6

INNER NOZZLE FOR TRANSFERRING MOLTEN METAL CONTAINED IN A VESSEL, SYSTEM FOR CLAMPING SAID NOZZLE AND CASTING DEVICE

CROSS-REFERENCE TO RELATED APPLICATIONS

The present application is a §371(c) national stage entry from PCT/EP2011/001326, filed on Mar. 17, 2011, which claims the benefit of foreign priority from EP 10157126.3, filed Mar. 19, 2010.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable

SEQUENCE LISTING

Not applicable.

BACKGROUND OF THE INVENTION (1) Field of the Invention

The present invention relates to the art of continuous molten metal casting. More specifically, it relates to the clamping of an inner nozzle in a continuous casting facility.

(2) Description of the Related Art Including Information Disclosed Under 37 CFR 1.97 and 1.98

In a casting facility, the molten metal is generally contained in a metallurgical vessel, for example a tundish, before being transferred to another container, for example into a casting mould. The metal is transferred from the vessel to the container via a nozzle system provided in the base of the metallurgical vessel, comprising an inner nozzle located at least partly in the metallurgical vessel and coming into tight contact with a sliding transfer plate (or casting plate) located below and outside of the metallurgical vessel and brought into registry with the inner nozzle via a device for holding and replacing plates, mounted under the metallurgical vessel. This sliding plate may be a calibrated plate, a casting tube or a saggar comprising two or more plates. Since all these types of plates are part of a nozzle comprising a plate connected to a tubular section of varying lengths depending on the applications and to distinguish them from valve gates used, e.g., in a ladle, they will be referred to herein as "sliding nozzle", "pouring nozzle", "exchangeable pouring nozzle" or combinations thereof. The pouring nozzle can be used to transfer the molten metal in the form either of a free flow with a short tube, or of a guided flow with a longer, partly submerged casting tube.

An example of such casting facility is described in the document EP1289696. To provide tight contact between the inner nozzle and the sliding pouring nozzle, the device for holding and replacing tubes comprises clamping means, intended to press against the inner nozzle, particularly downwards, and pushing means, intended to press on the sliding plate of the pouring nozzle, particularly upwards, so as to press the inner nozzle and the pouring nozzle against each other. These clamping and pressing means are generally arranged along the longitudinal edges of the inner nozzle and the sliding plate, the longitudinal direction corresponding to the plate replacement direction.

One difficulty lies in the fact that the tightness of the inner nozzle/sliding plate interface must be as perfect as possible, lest the molten metal may flow is between the two parts, damaging the surfaces of the refractory elements when replacing the pouring nozzle with a new one. Furthermore, the lack of tightness (contact between the two refractory elements) enables air to infiltrate, which is harmful both for the refractory elements and for the cast metal quality.

The present invention aims at enhancing the tightness of the contact surfaces between the inner nozzle plate and the sliding plate of the pouring nozzle. The present invention also aims at optimising the stress distribution in the refractory elements, for increasing their service time.

BRIEF SUMMARY OF THE INVENTION

The present invention is defined in the appended independent claims. Specific embodiments are defined in the dependent claims. In particular, the present invention concerns a tube exchange device for holding and replacing an exchangeable pouring nozzle for casting molten metal out of a vessel, said tube exchange device comprising a frame with a casting opening, said frame being suitable for being fixed to the lower side of a metal casting vessel and comprising a first, upper portion and a second, lower portion, joining at a middle section plane defining the plane where an inner nozzle and an exchangeable pouring nozzle form a sliding contact, the upper side portion of the frame comprising:

(a) means or at least one element for receiving and clamping in place at its pouring position a bearing surface of an inner nozzle against a support portion of the upper side portion of the frame, such that the through bore of the inner nozzle is in fluid communication with the casting opening, and the lower side portion of the frame comprising, (b) a passage extending along a first axis of first direction (X) between an inlet opening and an outlet opening suitable or disposed for receiving and moving an exchangeable pouring nozzle from said inlet to said outlet, passing by a casting position in registry with the casting opening of the frame, (c) means or an element for displacing and means or an element for guiding said exchangeable pouring nozzle from a standby position to a casting position in registry with the casting opening of the frame, and optionally for guiding it to the outlet, said guiding means or element running substantially parallel to the first direction (X), (d) pressing means or a pressing element aligned with the guiding means or element and extending substantially parallel to the first direction (X) at the level of the pouring nozzle casting position for pressing up said exchangeable pouring nozzle at its casting position in the direction of the upper portion of the frame, characterised in that at least two of the clamping means or elements are arranged transverse to said first direction (X).

In a specific embodiment, the clamping means or elements comprise at least a first clamping element (50*a*) intercepting and arranged substantially normal to said first direction (X).

In yet another embodiment, the clamping means or elements comprise three clamping elements, wherein the respective centroids of the orthogonal projections onto the middle section plane of the clamping elements in their clamped position form the vertices of a triangle. As commonly accepted by the person skilled in the art, the centroid of a plane figure is the point of intersection of all straight lines that divide said figure into two parts of equal moment about the line. In a triangle, the centroid is defined as the point of intersection of the medians. In particular, the triangle formed by the centroids of the clamping means projections or clamping element projections is defined by one or any combination of any of the following geometries:

(a) a first altitude of the triangle, referred to as X-altitude, passing through a first vertex, referred to as X-vertex, is substantially parallel to the first direction (X)

(b) A first median of the triangle referred to as X-median, passing through a first vertex, referred to as X-vertex, is substantially parallel to the first direction (X)

(c) a triangle according to (a) or (b) wherein the X-vertex points in the direction of the inlet opening;

(d) a triangle according to (a) or (b) wherein the X-vertex points in the direction of the outlet opening;

(e) all the angles of the triangle are acute;

(f) the triangle is isosceles, in one embodiment according to (a) and (b), in another embodiment according to (a) and (b) such that the X-vertex is the meeting point of the two sides of equal length, in still another embodiment according to (a), (b), and (e);

(g) a triangle according to (f) wherein the angle, $2\alpha$, formed by the centroid (46) of the casting opening and the two vertices of the triangle other than the X-vertex is comprised between 60 and 90°;

(h) a triangle wherein the angle formed by the X-vertex is smaller than 60°.

In certain embodiments a first clamping element corresponding to the X-vertex spans an angular sector, y, comprised between 14 and 52°, and the other two clamping elements (50*b*, 50*c*) span an angular sector, R, between 10 and 20°, all angles measured with respect to the centroid of the casting opening. In certain embodiments the inner ridge (i.e., adjacent the casting cavity) of the projection of said first clamping element intercept the first axis (X) with a tangent normal thereto. In certain embodiments, said first clamping element extending normal to the first direction (X) is movably mounted between an idle position and a clamping position, actuated from one position to the other by a crankshaft actuating means or crankshaft actuator.

In certain embodiments, the tube exchange device of the present invention comprises at least one gas connection to a gas source, said connection being arranged between two of the three clamping elements, and in certain embodiments points substantially parallel to the first direction (X).

The present invention also concerns an inner nozzle made of a refractory core material for casting molten metal from a metallurgical vessel, and suitable for being mounted on the upper portion of a pouring tube exchange device, said inner nozzle comprising:

(a) a substantially tubular portion with an axial through bore fluidly connecting an inlet opening to an outlet opening and (b) a plate comprising a first, contact surface normal to the axial through bore and comprising the outlet opening, and a second surface opposite to the first contact surface joining the wall of the tubular portion to the side edges defining the perimeter and thickness of the plate, characterized in that, the inner nozzle plate comprises three separate bearing elements jutting out of the side edges, each comprising a bearing ledge facing in the direction of the contact surface and distributed around the perimeter of the plate, wherein the centroids of the orthogonal projections onto a plane parallel to the contact surface of the bearing ledges form the vertices of a triangle.

In certain embodiments, the triangle formed by the centroids of the projections of the three bearing ledges is defined by one or any combination of any of the following geometries:

(a) a first altitude of the triangle, referred to as X-altitude, passing through a first vertex, referred to as X-vertex, is substantially parallel to a first axis (X)

(b) a first median of the triangle referred to as X-median, passing through the X vertex, is substantially parallel to said first axis (X)

(c) a triangle such that either the X-altitude or the X-median intercepts the central axis (Z) of the nozzle through bore at the through bore centre (46).

(d) all the angles of the triangle are acute;

(e) the triangle is isosceles, in certain embodiments according to (a) and (b), in certain embodiments according to (a), (b), and (c) such that the X-vertex is the meeting point of the two sides of equal length, and in certain embodiments according to (a), (b), (c), and (d);

(f) a triangle according to (c) wherein the angle, $2\alpha$, formed by the through bore centre and the two vertices of the triangle other than the X-vertex is comprised between 60 and 90°;

(g) a triangle wherein the angle formed by the X-vertex is smaller than 60°.

All but the first, contact surface of the inner nozzle plate are in certain embodiments at least partially clad with a metal casing with the three bearing ledges being part of said metal casing. In a certain embodiment, the inner nozzle comprises gas connection means or a gas connection element in fluid communication with the casting through bore of the inner nozzle, so that the molten metal flowing through the inner nozzle can be covered by a blanket of an inert gas, such as Ar, He, Ne, and the like. The gas connection means or element can also be in fluid communication with a groove lying on the contact surface 26 of the inner nozzle, in order to protect the metal melt from oxidation in case of a leak at the interface between the inner nozzle contact surface and the pouring nozzle sliding surface. The gas connection element or means are, in certain embodiments, arranged between two bearing ledges.

The present invention also concerns an assembly of a tube exchange device as defined above and of an inner nozzle, wherein the inner nozzle comprises bearing elements mating the clamping means or elements of the tube exchange device. In certain embodiments the inner nozzle is also as defined above.

The present invention also concerns a metallic casing for cladding an inner nozzle as defined above, said metal casing comprising a main surface with an opening for accommodating the nozzle's tubular portion and side edges extending from the perimeter of the main surface, characterised in that said metallic casing comprises three separate bearing elements jutting out of said side edges, each bearing elements comprising a bearing ledge being oriented away from said main surface and being arranged around the periphery of the metal casing such that the centroids of each of said three bearing elements form the vertices of a triangle. The word centroid here means the geometric centre of the object's shape. The various geometries of the bearing ledges of the inner nozzle defined above apply mutatis mutandis to the present metal casing since the ledges are part of the metal casing.

BRIEF DESCRIPTION OF THE SEVERAL VIEWS OF THE DRAWINGS

The invention will be understood more clearly on reading the following description, merely given as a non-limitative example of the scope of the invention, with reference to the figures, wherein:

FIG. 2 is a top view of the nozzle of FIG. 1 clamped in place in a tube exchange device according to the present invention;

FIG. 2*a* is a sectional view illustrating the structure of a clamping element of FIG. 2;

FIGS. 6*a-c* show the compressive stress distribution around the casting channel for various distributions of the inner nozzle clamping means or elements.

DETAILED DESCRIPTION OF THE INVENTION

Figure 1A:
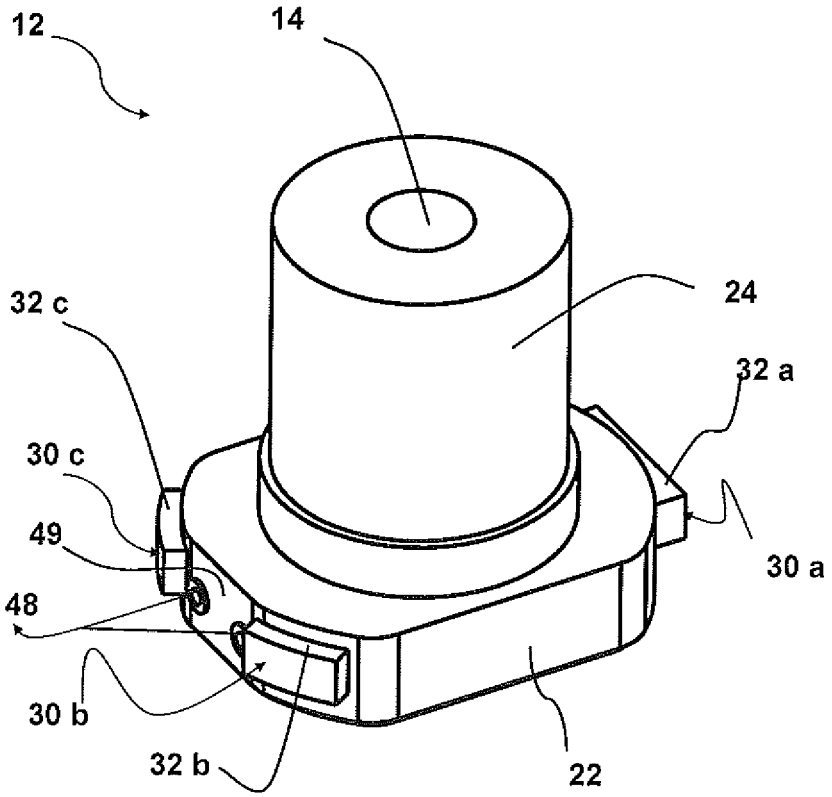
FIG. 1*a* is a perspective view of an inner nozzle according to one embodiment, in its casting orientation.

The present invention relates to a tube exchange device for holding and replacing a sliding nozzle mounted under a metallurgical vessel for casting molten metal contained in the vessel, and for guiding the sliding nozzle to a casting position wherein it extends from a casting channel of an inner nozzle provided on the metallurgical vessel. The plate replacement direction corresponding to a longitudinal direction of the device, and the directions non-parallel to said longitudinal direction corresponding to transverse directions of the device, with the direction perpendicular to the longitudinal direction being referred to as the normal direction. The sliding plate of the pouring nozzle and the inner nozzle each having two substantially longitudinal edges and two transverse, generally normal edges.

The present invention proposes to apply the clamping force along the transverse edges of the inner nozzle, whilst the pressing force is applied onto the longitudinal edges of the pouring nozzle, such that the tightness at the transverse edges of the inner nozzle/sliding plate contact plane is improved. In other words, due to the clamping means or elements and pushing means or elements arranged in this way, it is possible to apply a force setting the contact on substantially the entire circumference of the inner nozzle/sliding nozzle contact plane, hence superior tightness and thus a greater service life of the parts and improved cast metal quality. In particular, the inventors noted that it is more advantageous to apply the forces in this way than when the opposing thrust force and the clamping force are applied, as in the prior art, in that the high pressure on the longitudinal edges of the inner nozzle and the sliding plate may bend and separate the respective transverse edges.

Moreover, the clamping means or elements positioned in the transverse direction may further contribute to further referencing the inner nozzle in relation with to the frame of the tube exchange device along the longitudinal direction, which is particularly advantageous. Indeed, the inner nozzle is subject to substantial shear forces in the longitudinal direction during plate the replacement of a pouring nozzle, and the clamping forces distributed in the transverse direction contribute to enhancing the stability of the inner nozzle in the longitudinal direction, and thus lock said nozzle in the longitudinal direction despite the shear stresses movements due to plate replacements.

The terms "clamping means" or "clamping elements" refer to means or elements rotatably mounted on the frame of the tube exchange device for applying a clamping force onto a clamping surface of an inner nozzle, said force being transmitted to an opposite bearing surface against a matching support surface of the frame of the tube exchange device. Generally, the force applied by the clamping means or elements onto the inner nozzle is a downward force, applied onto a top surface of the inner nozzle, and the force applied by the pressing means or elements onto the sliding nozzle plate is opposed to the former and generally oriented upwards, applied onto the bottom surface of the plate. The vertical direction is defined as the direction of flow of the molten metal at the metallurgical vessel outlet. The transverse direction is defined as any direction secant to the longitudinal direction, and the normal direction is perpendicular to both longitudinal and vertical directions, such that the longitudinal, normal and vertical directions define an orthogonal referential. Furthermore, it should be noted that the forward direction is defined with reference to the nozzle replacement direction in the tube exchange device, the plate being moved from the rear to the front to adopt the following successive positions: standby position (when another nozzle is already in the casting position), casting position (when the bore of the pouring nozzle is in registry with the inner nozzle through bore), sealing position (when a sealing surface provided on the plate of the pouring nozzle faces and seals the inner nozzle through bore outlet) and ejection position (when the plate sliding face is released from the tube exchange device). It should also be noted that several refractory surfaces of the plates of both the inner nozzle and the pouring nozzle are generally clad with a metallic casing. The pouring nozzle generally comprises a tubular extension of varying lengths depending on the applications. The tubular extension may be extended sufficiently so that the end thereof is immersed in the downstream metallurgical vessel, for example in continuous casting moulds. The casting tube to be immersed is made of refractory element.

Hereinafter, the substantially vertical direction, corresponding to the casting direction, is referred to as the Z-direction, and the central axis of the through bore of the inner nozzle as the Z-axis, which is parallel to the Z-direction when the inner nozzle is mounted in its casting position on the tube exchange device. The longitudinal direction, corresponding to the plate replacement direction, is referred to as the X direction, which is substantially normal to the Z-direction; the X axis is parallel to the X-direction and passes through the centroid of the casting opening of the tube exchange device.

The present invention is based on the observation that on traditional tube exchange devices, as disclosed e.g., in EP1289696, wherein the clamping means or elements for holding the inner tube on the upper portion of the frame are positioned substantially parallel to the X-direction, and substantially on top of the pressing means or elements 18 pressing the pouring nozzle up against the contact surface of the inner nozzle 12 yielded problems of tightness. The inventor carried out a stress distribution analysis around the casting opening and realized that the level of compressive stress in the transverse portion of the plates was much lower than in the longitudinal sides, yielding the possible formation of a thin, albeit unacceptable gap that could lead to leakage of metal melt (cf. FIG. 6*a*). The solution proposed in the present invention to solve this problem is to locate at least two, preferably three clamping elements 20 transverse to the X-direction along which the pressing means or elements 18 are aligned. This apparently simple solution unexpectedly solves the problem of leakage risk of the prior art exchange tube systems, as will be seen in continuation.

In a continuous molten metal casting facility, such as for casting molten steel, a device 10 for holding and replacing sliding nozzles is used for transferring the metal contained in a metallurgical vessel, for example a tundish, to a container, such as one or a plurality of casting moulds. The device 10, partly represented in FIG. 2, is mounted under the metallurgical vessel, in registry with an opening in the floor thereof, such as to insert therethrough an inner nozzle 12, fixed to the frame of a tube exchange device 10 and attached to the base of the metallurgical vessel, for example with cement. A side view representation of a typical tube exchange device can be found in FIG. 1 of EP1289696. The through bore 14 of the inner nozzle 12 defines a casting channel and the device 10 is arranged such that it can guide the sliding plate of a pouring nozzle to a casting position, such that the axial bore of the latter comes in fluid communication with the through bore 14 of the inner nozzle. For this purpose, the device 10 comprises means or elements 16 for guiding the sliding nozzle through an inlet and from a standby position to a casting position. For example the guiding means can be in the form of guiding rails 16. The rails 16 are arranged along the longitudinal edges 17*a*, 17*b* of the channel of the device 10 leading from the device inlet, to the idle position and to the casting position, Moreover, at the pouring nozzle casting position, the device 10 comprises means or elements 18 arranged parallel to the X-direction for pressing the plate of the pouring nozzle against the contact surface of the inner nozzle 12, for example compressed springs 18, said means being arranged to apply a force on a bottom surface of each of the two longitudinal edges of the sliding plate of the pouring nozzle, so as to press the plate in tight contact against the contact surface of the inner nozzle 12 and thus to create a fluid tight connection between the through bore 14 of the inner nozzle and the axial bore of the pouring nozzle. As can be seen in FIG. 2, the springs 18 are distributed along the longitudinal edges 17*a*, 17*b* of the device 10 substantially parallel to the X-direction. The device 10 further comprises means or elements 20 for clamping the inner nozzle, described in more detail below, and arranged to apply a force on a top surface of two transverse edges of the inner nozzle 12, so as to keep the inner nozzle pressing against the device 10. The term transverse means in the present context, not parallel to, or secant with the X-direction.

Figure 1B:
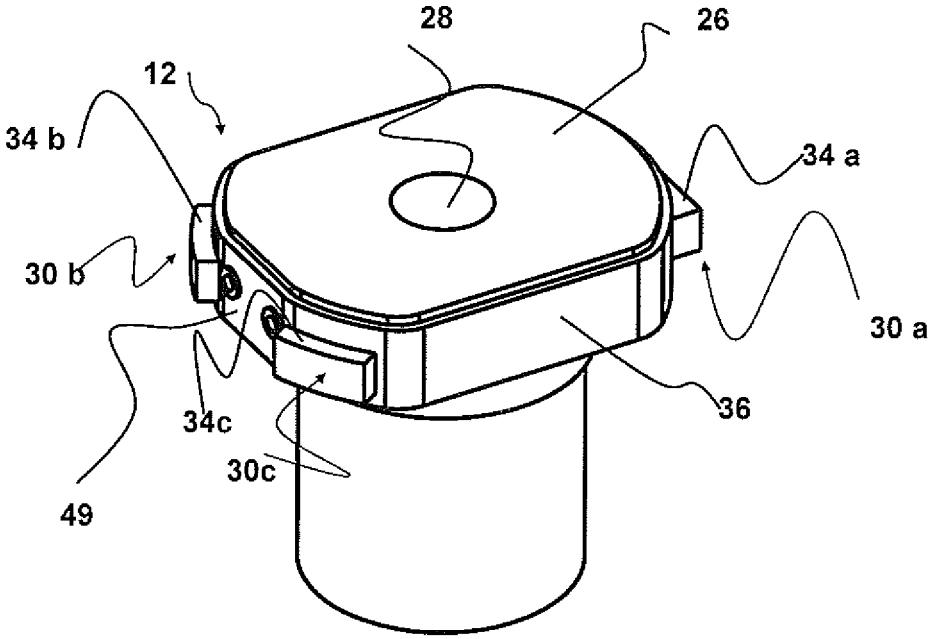
FIG. 1*b* is a perspective view of the nozzle of FIG. 1*a* when it is turned up side down in the vertical direction.

The inner nozzle 12 comprises a metallic casing 22, cladding all but the first, contact surface (26) of the inner nozzle plate 24 made of a refractory material, as can be seen in FIG. 1*b*. The metallic casing 22 reinforces the refractory element 24 and is preferably bonded to the plate using a cement, The refractory plate is essential to support the high temperatures wherever the nozzle contacts metal melt, but its mechanical properties, in particular compression, shear, friction, and wear resistance are insufficient wherever there is concentration of stresses. For this reason, the refractory plate is clad with a metal casing wherever mechanical stresses are applied but away from any possible contact with molten metal. The thickness of the metal casing may vary from about 1 mm to greater than 6 mm, the thicker walls being generally when the metal casing is made of cast iron. The metallic casing lies clear from the contact surface 26 of the inner nozzle (cf. FIG. 1*b*) as the latter is to be brought in intimate contact with the sliding surface of the plate of a pouring nozzle. Metal could not be used for cladding the contact surface because it would be damaged in case of any leak of metal melt with dramatic consequences. As mentioned supra, the contact surface 26 of the inner nozzle is intended to be brought into tight contact with the sliding surface of a pouring nozzle when said nozzle is pushed in place by the device 10 to the casting position, i.e. facing the inner nozzle 12. One end of the inner nozzle through bore 14 opens at the contact surface 26.

The inner nozzle 12 comprises three separate bearing elements 30*a*, 30*b*, 30*c* jutting out of the side edges and distributed around the perimeter of the plate. Each bearing element comprises a bearing ledge (34*a*, 34*b*, 34*c*) facing in the direction of the contact surface 26. The centroids of the orthogonal projection of the respective ledges onto a plane parallel to the contact surface 26 form the vertices of a triangle. The bearing elements and ledges thereof are actually part of the metallic casing cladding parts of the plate of the inner nozzle. This is advantageous because the clamping force is applied to a metal surface which does not crumble like refractory could possibly do when exposed to high compressive and shear stress concentrations. The surfaces of the three ledges define the bearing surface. They are preferably coplanar, but this is not essential to the present invention. They are preferably parallel to the contact surface 26 but this is not essential either, as a slight slope of the ledges can help to centre the inner nozzle on the tube exchange device 10. It is clear, however, that the bearing ledges of the inner nozzle must match the support portion and clamping means or elements 20 of the tube exchange device 10. Opposite the bearing ledges (34*a*, 34*b*, 34*c*), the inner nozzle comprises clamping surfaces (32*a*, 32*b*, 32*c*) which are suitable for receiving the clamping means or elements of the tube exchange device, such as to clamp into position the bearing ledges of the inner nozzle against matching support portions of the frame of the tube exchange device. The clamping surfaces are preferably metallic and may be part of the second surface of the plate, opposite the contact surface or they can be part of the bearing elements but separate from said second surface as illustrated in FIG. 1.

The bearing elements 30*a*, 30*b*, 30*c* are separate and project from a peripheral surface 36 of the plate of the inner nozzle 12, said surface 36 extending from the bottom contact surface 26 of the plate, in certain embodiments in a substantially vertical direction Z. In one embodiment, refractory material may extend between the bearing ledge and the clamping surface of a bearing element of the inner nozzle. In this embodiment, a portion of the refractory is exposed to the compressive stresses of the clamping means or elements 20, but any stress concentration is distributed by the metal layer separating the refractory from the clamping means or elements and support surfaces of the tube exchange device. In certain embodiments, the bearing ledge and opposed clamping surfaces are separated by metal only. This ensures that the clamping force is not applied to the refractory at all, but to metal only. Like in the example illustrated in the figures, the three bearing elements 30*a*, 30*b*, 30*c* are entirely made of metal, i.e. there is only metal between the bearing ledges 34*a*, 34*b*, 34*c* and the clamping surfaces 32*a*, 32*b*, 32*c*.

Figure 3:
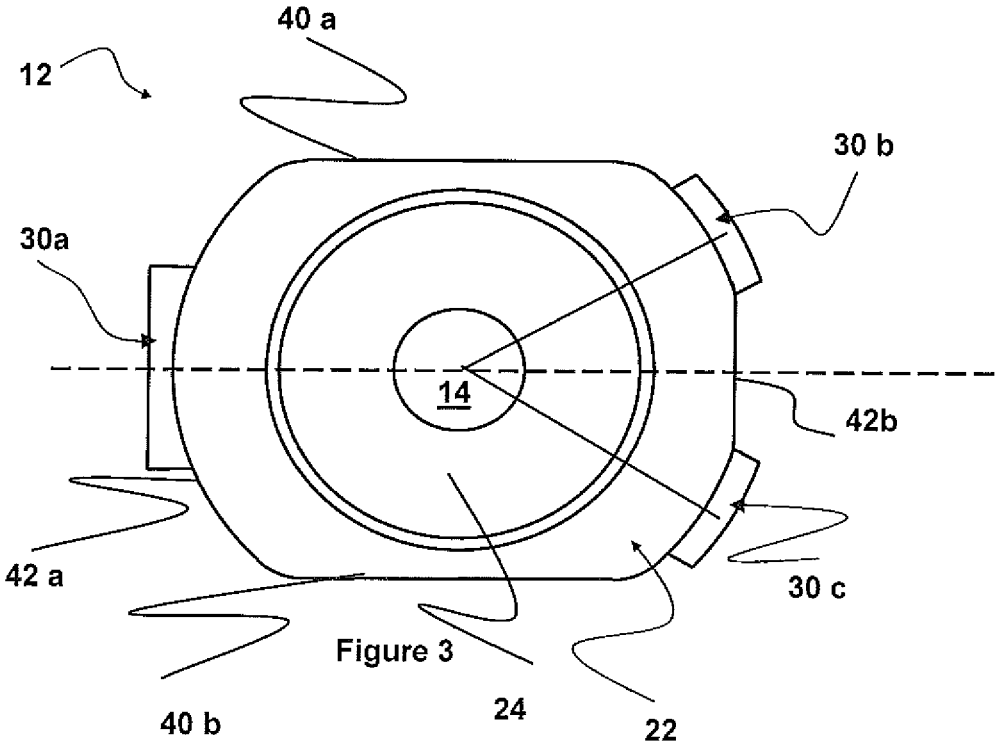
FIGS. 3 and 3*a* are top views of the nozzle of FIG. 1.
Figure 3A:
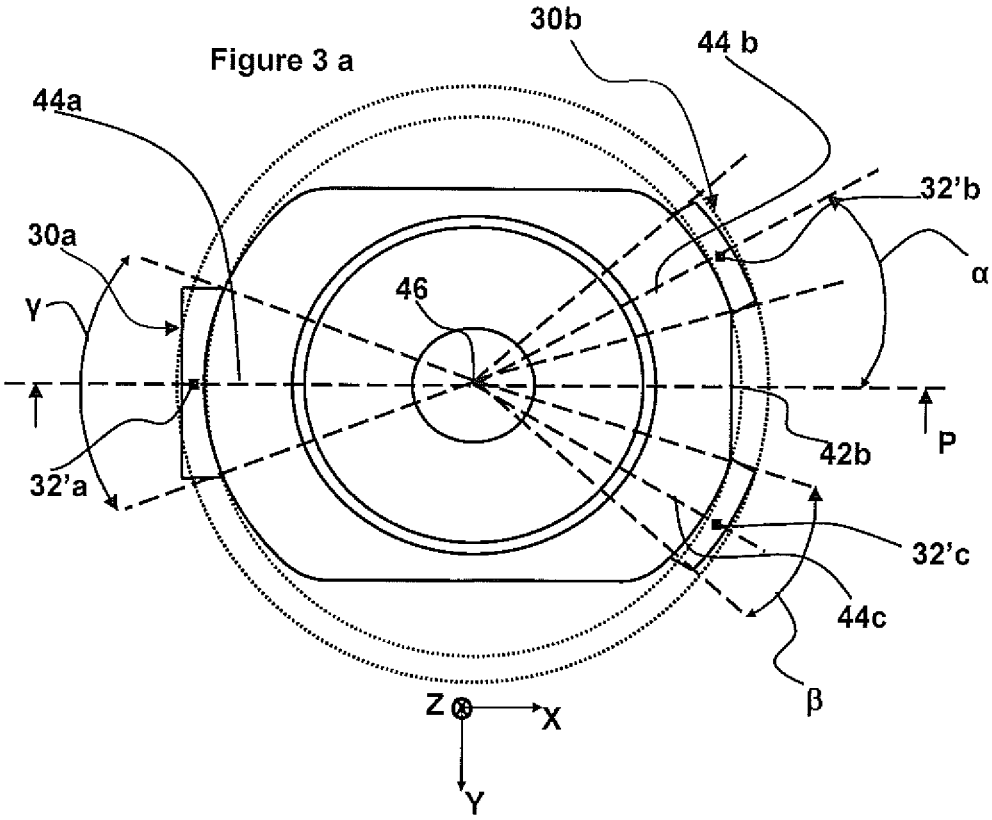
Figure 4:
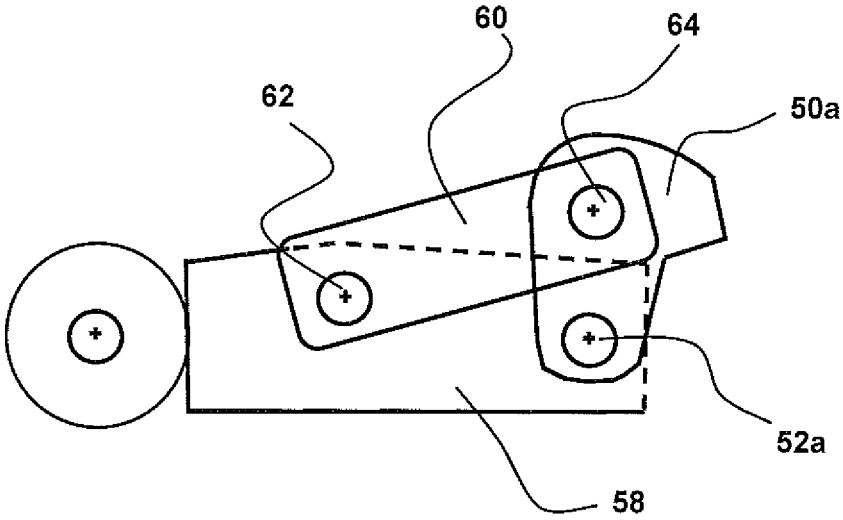
FIG. 4 is a sectional view of a clamping element.

As can be seen in FIG. 3, the inner nozzle 12 has two substantially longitudinal opposite edges 40*a*, 40*b* and two opposite edges: 42*a*, 42*b*, substantially normal to the longitudinal edges. Furthermore, a vertical central longitudinal plane P can be defined by the X-, and Z axes and the three bearing elements 30*a*, 30*b*, 30*c* may be arranged in a Y shape on the periphery 36 of the nozzle 12, the base 44*a* of the Y being arranged in the central longitudinal plane P coaxially with X-axis and the two arms 44*b*, 44*c* of the Y being arranged on either side of said plane P and all arms of the Y meeting at the centroid 46 of the inner nozzle through bore 14. More specifically, the second 30*b* and third 30*c* bearing elements have a second 34*b* and a third 34*c* bearing ledges, each of these second 34*b* and third 34*c* bearing ledges being arranged on either side of the longitudinal plane P. In the example described, the second and third bearing ledges are arranged symmetrically, but this is not necessarily the case. Furthermore, each of the orthogonal projections of the three bearing ledges 34*b*, 34*c* onto a plane parallel to the contact surface 26 have a centroid 34'*b*, 34'*c* positioned at an angle α (alpha) between 30 and 45° in relation to the longitudinal plane P, with reference to the centroid 46 of the inner nozzle 12, corresponding to the centre of the casting orifice 28. Furthermore, each of the second 34*b* and third 34*c* bearing ledges is included in an angular sector R (beta) between 10 and 20° with reference to the centre 46 of the inner nozzle 12. Moreover, the first bearing element 30*a* has a first bearing ledges 34*a* passing through the longitudinal plane P of the nozzle 12. More specifically, the bearing ledge 34*a* extends substantially symmetrically in relation to the plane P, the centroid 34'*a* of this surface being positioned in the plane P. The bearing ledge 34*a* may extend in a surface included in an angular sector y (gamma) between 14 and 52° with the reference to the centre 46 of the inner nozzle. In the case represented in FIG. 3, the centroids 34'*a*, 34'*b*, 34'*c* of the projection of the bearing ledges corresponds to the centroids of the projection of the clamping surfaces 32'*a*,32'*b*,32'*c*.

The inner nozzle 12 may further comprise gas connection means or elements 48, in fluid communication with the inner nozzle central bore 14 and/or with a groove lying on the contact surface 26. It is preferred that, said means or elements 48 are arranged between the second 30*b* and third 30*c* bearing elements. In this instance, the means or elements 48 comprises or comprise one or two channels opening onto a transverse vertical surface or transverse edge 49 belonging to the peripheral surface 36 and connecting the two bearing elements 30*b*, 30*c*. The injected gas is, for example, argon.

The clamping means or elements 20 of the tube exchange device comprise two clamping elements arranged transverse to the X-axis. Preferably, three clamping elements 50*a*, 50*b*, 50*c*, are arranged in a Y shape at the periphery of the inner nozzle 12 (cf. FIG. 2), i.e. a first clamping element 50*a* at the base of the Y, arranged on the rear portion of the central longitudinal plane P and a second 50*b* and a third 50*c* clamping elements, at the ends of both arms of the Y, arranged on either side of the front portion of said plane P. As can be seen, the clamping means or elements are arranged to apply the force thereof on the transverse edges 42*a*, 42*b* of the inner nozzle. The clamping elements 50*a*, 50*b*, 50*c* have a complementary configuration of the bearing elements 30*a*, 30*b*, 30*c*. In this way, the first 50*a*, second 50*b* and third 50*c* clamping elements respectively apply a clamping force on the first 34*a*, second 34*b* and third 34*c* bearing ledges described above.

The second and third clamping elements 50*b*, 50*c* may be substantially identical. Only the structure of the element 50*b* will thus be described, with reference to FIGS. 2 and 2*a*. The clamping element 50*b* is rotatably mounted on an axis 52*b* attached on the frame 31, extending substantially in a transverse direction. The element 50*b* has one free end bearing a so-called clamping surface 54*b*, intended to come into contact with the clamping surface 32*b* of the bearing element 30*b*, and apply a clamping force on said surface 32*b* by pressing thereon. For this purpose, the element 50*b* is actuated by a rotary device 56*b* (pivoting about a vertical axis) acting as a cam in contact with the element 50*b*. More specifically, when the cam 56 is rotated, it applies a horizontal force on the free end of the element 50*b*, according to the arrow illustrated in FIG. 2*a*, which pivots the free end downwards, and thus the surface 54*b* about the axis 52*b*. The downward pivoting of the surface 54*b* thus generates a clamping force on the surface 32*b* which is transmitted to the opposite bearing ledge 34*b* which is clamped into position against the corresponding support portion of the frame. It should be noted that the clamping element 50*b* does not only apply a downward clamping force, but also a horizontal force, intended to lock the ledge 34*b* horizontally. Other clamping mechanisms known to the person skilled in the art can be used within the scope of the present invention, as it is the orientation rather than the clamping mechanism of the clamping means or clamping element that define the gist of the present invention.

The structure of a first clamping element 50*a* will now be described, with reference to FIGS. 4, 5 and 5*a* to 5*d*. The first clamping element 50*a* has a similar shape to that of the element 50*b* represented in FIG. 2*a*, except that it may extend over a larger surface than the element 50*b*. The element 50*a* is rotatably mounted on an axis 52*a* attached on the frame 31, extending in a direction transverse to the X-direction, and has a free end bearing a clamping surface 54*a*, intended to come into contact with the clamping surface 32*a* by pressing thereon. The element 50*a* can be actuated differently than the element 50*b*, particularly by means acting as a connecting rod. More specifically, it is actuated by a rotary device 56*a* pivotably mounted about an axis in the example normal to the X-axis and acting as a cam in contact with a cylinder 58. The cylinder 58 can move by translation in the X direction. It bears a rod 60 acting as a connecting rod, one end 62 of which is rotatably mounted about the free end of the clamping elements 58 and the opposite end 64 of which is rotatably mounted about the free end of the clamping element 50*a*, the element 50*a* acting as a connecting rod. Moreover, the cylinder 58 forms a housing for a rod 66 returned by return means or return element 68 of the clamping element 50*a* in the idle position, e.g., a compressed spring.

Figure 5:
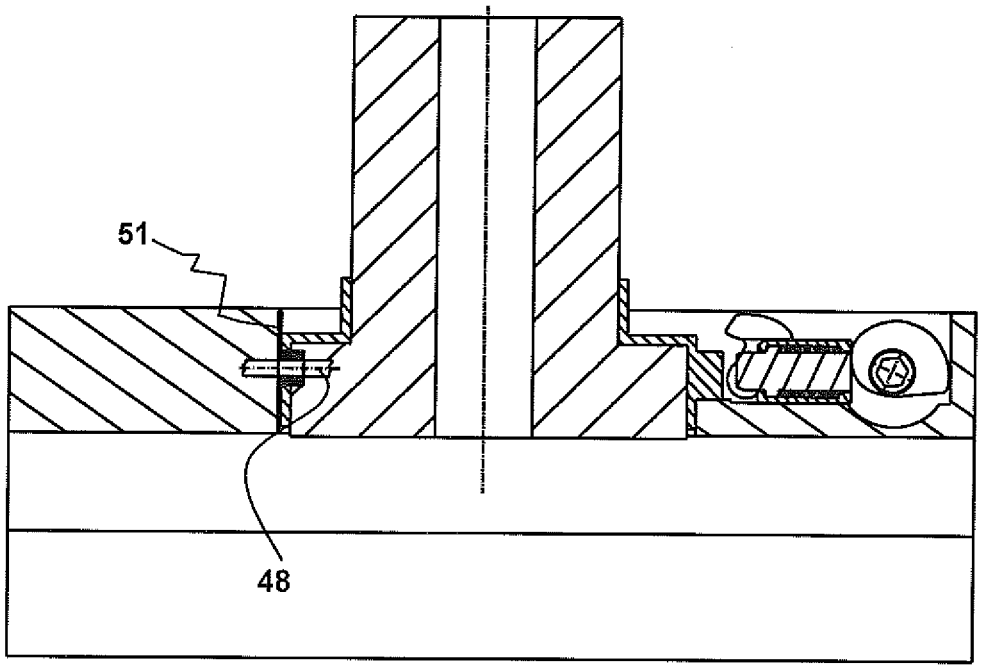
FIG. 5 is a sectional side view of the inner nozzle of FIG. 1 standing in its casting position on the tube exchange device prior to being clamped.
Figure 5A:
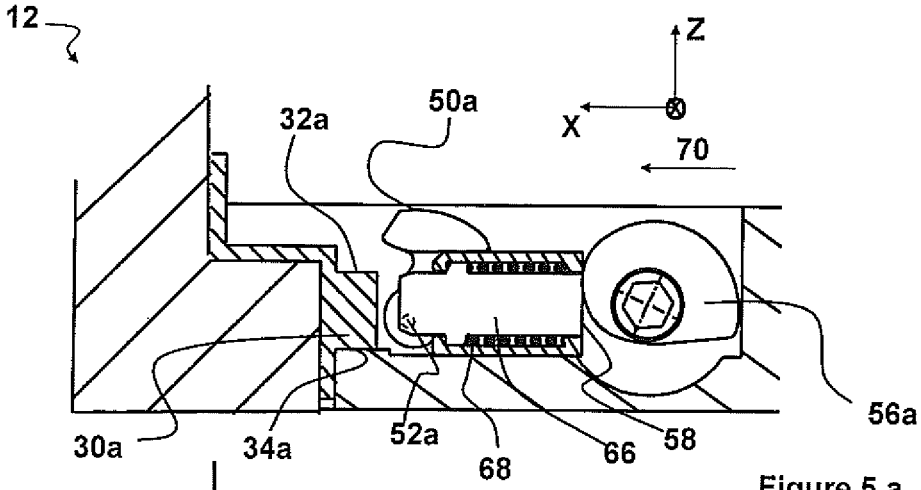
FIGS. 5*a* to 5*d* are sectional views along a longitudinal plane illustrating the clamping steps of the clamping means or elements in FIG. 4 for clamping one support ledge of an inner nozzle.
Figure 5B:
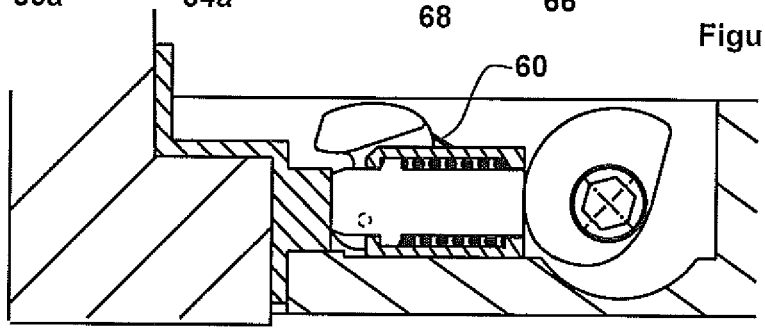
Figure 5C:
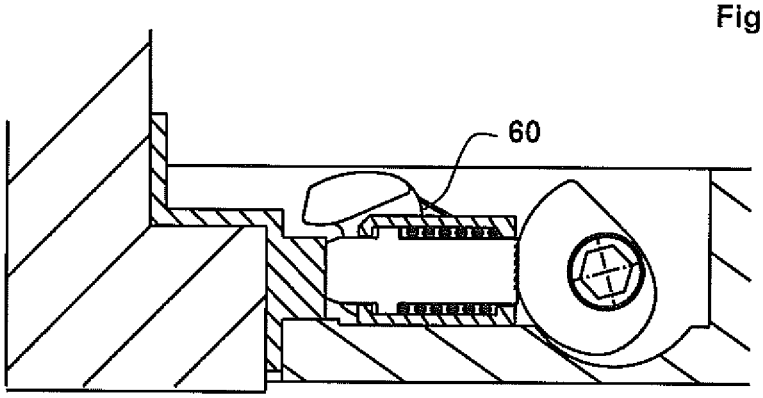
Figure 5D:
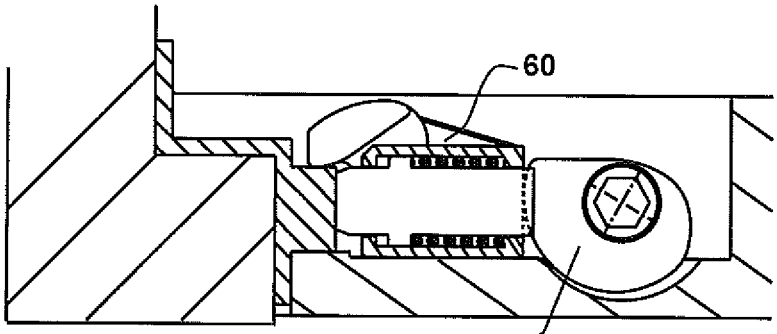

The clamping element 50*a* is movably mounted between an idle position and a clamping position, actuated by the connecting rod system, as follows. The idle position is illustrated in FIG. 5*a*. To move to the clamping position, it is necessary to rotate the movable device 56*a* about the axis thereof, such that it moves the cylinder 58 in the horizontal direction illustrated by the arrow 70. As a result of this translation, the connecting rod 60 rotates the element 50*a* about the axis 52*a* thereof, as illustrated in FIGS. 5*b*, 5*c* and 5*d*, such that the clamping surface 54*a* of the clamping element presses on the clamping surface 32*a* of the bearing element and the clamping element 50*a* adopts the clamping position thereof. Simultaneously with the translation of the cylinder 58, the rod 66 abuts against the vertical wall of the bearing element 30*a*, which compresses the spring 68 as illustrated in FIGS. 5*c* and 5*d*. By means of the compression of this spring, the system can return to the idle position simply by rotating the device acting as a cam 56*a*. Indeed, in such crankshaft system, when the element 50*a* is in the clamping position, as illustrated in FIG. 5*d*, the rotation of the device 56*a* enables the cylinder 58 to move by translation in the direction indicated by the arrow 72 under the action of the spring 68 which is released, and thus enables the clamping element to return to the position illustrated in FIG. 5*a*.

The device 10 illustrated in the appended figures further comprises, between the two clamping elements 50*b*, 50*c*, two gas injection channels for the nozzle 12, opening on a vertical transverse surface 51 of the device 10. In this way, when the element 50*a* is in the clamping position, the injection channels of the device 10 extend from the channels 48 of the nozzle 12, and the clamping positions of the elements 50*b*, 50*c* provide a particularly tight junction of said channels.

The method for clamping the inner nozzle 12 in the device 10 will now be described on the basis of the embodiment illustrated in the figures. At the start of the clamping method, the inner nozzle 12 is simply placed onto the frame 31 of the tube exchange device 10. The clamping method comprises a first step of abutting the transverse vertical surface 49 of the nozzle 12, arranged between the bearing elements 30*b*, 30*c*, against the transverse vertical surface 51 of the frame 31 of the device 10, followed by actuation of the first clamping element 50*a* in the clamping position. The first element 50*a* thus moves by translation in accordance with the arrow 70 in FIG. 5*a*, abuts against the bearing element 30*a*, pressing the inner nozzle 12 against the front transverse edge 51 of the device 10, thus referencing same very precisely against said front edge. It is understood that the establishment of the clamping position by the clamping element 50*a* simultaneously gives rise to the compression of seals arranged in the gas injection channels 48. The seals may be positioned on the inner nozzle or on the device. They are preferably made of graphite. The translation along the arrow 70 enables controlled compression. Once the clamping element 50*a* is in the clamping position, the assembly method is followed by optionally simultaneous actuation of the two clamping elements 50*b*, 50*c* in the clamping position. The clamping of the first element 50*a* followed, in a second step, by the clamping of the two other elements 50*b*, 50*c*, enables a particularly simple method, all the clamping elements 50*a*, 50*b*, 50*c* and the actuation means or element thereof forming a particularly advantageous clamping system.

Among the benefits of the inner nozzle 12 and the tube exchange device 10 described above, it should be noted that the clamping means or element apply the force thereof on the transverse edges 42*a*, 42*b* of the inner nozzle, whereas the pressing means or element 18 apply the force thereof onto the longitudinal edges of the plate of the sliding pouring nozzle against the longitudinal edges 17*a*, 17*b* of the device 10. As a result, a pressure is applied on substantially the entire circumference of the contact surface between the inner nozzle 12 and the sliding plate, hence superior tightness (cf. FIG. 6(*c*)).

Another advantage of the present invention, is that, after use of the inner nozzle 12, the same metallic casing 22 can be used again to clad a new refractory element 24.

The present invention clearly enhances the fluid tightness of the interface between the contact surface 26 of an inner nozzle and the sliding surface of the plate of a pouring nozzle in a tube exchange device 10. FIG. 6 shows the compressive stress distribution calculated as a result of the arrangement of the clamping means or elements around the periphery of the casting opening: the darker the colouration, the higher the compressive stress. In FIG. 6(*a*) is represented a prior art configuration as described, e.g., in EP1289696 with the clamping means or elements 20 for clamping in place the inner nozzle arranged along the longitudinal edges, parallel to the X-axis and lying substantially on top of the pressing means or pressing elements 18 for pressing the sliding surface of the pouring nozzle against the contact surface 26 of the inner nozzle. It can be seen that the pressure is high only in the portion adjacent the longitudinal edges, with a low pressure along the transverse direction, yielding a high risk of leakage of molten metal upon casting and significant air aspiration. FIGS. 6(*b*) and (*c*) on the other hand are according to the present invention.

In FIG. 6(*b*) there are two clamping elements 20 for clamping the inner nozzle, which are positioned substantially normal to the X-axis. It can be seen that the portion of the plate comprising the X-axis is exposed to a higher level of pressure than in the former geometry of FIG. 6(*a*). In FIG. 6(*c*), three clamps are arranged around the perimeter of the inner nozzle, wherein the centroids of the orthogonal projections of each clamping means or clamping element 20 in their clamped positions on the plane of the contact surface of the inner nozzle form the vertices of a triangle, or the arms of a 'Y' joining at the centroid 46 of the through bore of the inner nozzle as discussed above. It can be seen in FIG. 6(*c*) that the level of compression is very homogeneous with the whole perimeter of the plates being exposed to a high pressure, thus ensuring fluid tightness of the interface between the two surfaces of the inner nozzle and the pouring nozzle. Since the three clamp system seems to be so efficient, several embodiments of three clamp systems are discussed.

An altitude of a triangle is a straight line through a vertex and perpendicular to the opposite side. The intersection of the altitudes is the orthocentre. A median of a triangle is a straight line through a vertex and the midpoint of the opposite side, and divides the triangle into two equal areas. The intersection point of the medians of a triangle is called the centroid.

In a certain embodiment one median, referred to as the X-median and/or an altitude referred to as the X-altitude, both passing by the X-vertex of the projected triangle is coaxial with the X-axis, as represented in FIGS. 2(*a*) and 6(*c*). The other two clamping means or elements 20 are disposed on either sides of the X-axis. Preferably, the triangle is isosceles with the two sides of equal length joining at the X-vertex, as is depicted in the foregoing Figures.

The X-vertex may point in the direction of the inlet opening. This configuration is advantageous in case of a gas connection located between the second and third vertices, other than the X-vertex, as the friction applied in the longitudinal direction by a pouring nozzle being inserted into, respectively extracted from the lower portion of the tube exchange device would push the inner nozzle against said connection, thus ensuring a gas tight connection. Furthermore, the frictional forces cooperate with the crankshaft system installed on the first clamping means or clamping element as explained supra. Alternatively, the X-vertex may be pointing towards the outlet opening.

In a certain embodiment, all the angles of the triangle are acute to ensure an even distribution of the clamping means or elements around the periphery of the nozzle. In a particular embodiment, the X-vertex is smaller than 60°. The angle, $2\alpha$, on the other hand, formed by the centroid (46) of the casting opening and the two vertices of the triangle other than the X-vertex is preferably comprised between 60 and 90°;

in certain embodiments in the Figures, the triangle is isosceles, in some embodiments with the X-median being coaxial with the X-axis. In certain embodiments the X-vertex is the intersecting point of the two sides of equal length (with this configuration, the X-median and the X-altitude are coaxial.

Numerous modifications and variations of the present invention are possible. It is, therefore, to be understood that within the scope of the following claims, the invention may be practiced otherwise than as specifically described.

10. Tube exchange device;
12. inner nozzle;
14. Inner nozzle through bore;
16. guiding means;
17*a*, 17*b* longitudinal edges of device;
18. pressing means;
20. clamping means;
22. metallic casing;
24. refractory element;
26. contact surface;

28. casting opening;
30*a*, 30*b*, 30*c* Bearing elements;
31. frame;
32*a*, 32*b*, 32*c* Clamping surface of the bearing elements;
34*a*, 34*b*, 34*c* bearing ledge of the bearing elements;
36. peripheral surface;
40*a*, 40*b* longitudinal edges of nozzle;
42*a*, 42*b* transverse edges of nozzle;
44*a* Base of Y;
44*b*, 44*c* arms of Y;
46. centroid of the through bore opening of the inner nozzle;
48. gas injection means;
49. transverse surface of nozzle;
50*a*, 50*b*, 50*c* clamping elements;
51. transverse surface of device;
52*a*, 52*b* clamping element axis;
54*b* clamping surface of clamping element;
56*a*, 56*b*, 56*c* rotary device or cam;
58. cylinder;
60. rod acting as connecting rod;
66. Rod;
68. return means;
70. Horizontal direction;
72. Opposite direction of direction 70.

We claim:

1. Inner nozzle made of a refractory core material for casting molten metal from a metallurgical vessel, and disposed to be mounted on the upper portion of a pouring tube exchange device, said inner nozzle comprising:

(a) a substantially tubular portion with an axial through bore fluidly connecting an inlet opening to an outlet opening and (b) a plate comprising a first, contact surface normal to the axial through bore and comprising the outlet opening, and a second surface opposite to the first contact surface joining the wall of the tubular portion to the side edges defining the perimeter and thickness of the plate, wherein all but the first contact surface of the inner nozzle plate are at least partially clad with a metal casing having side edges, wherein the metal casing comprises three separate bearing elements jutting out of the side edges, each bearing element comprising a bearing ledge facing in the direction of the contact surface and distributed around the perimeter of the plate, wherein the centroids of the orthogonal projections onto a plane parallel to the contact surface of the bearing ledges form the vertices of a triangle.

2. Inner nozzle according to claim 1, wherein the triangle formed by the centroids of the projections of the three bearing ledges is defined by at least one geometry selected from the group consisting of:

(a) a first altitude of the triangle, referred to as X-altitude, passing through a first vertex, referred to as X-vertex, is substantially parallel to a first axis (X)

(b) a first median of the triangle referred to as X-median, passing through the X vertex, is substantially parallel to said first axis (X)

(c) a triangle such that either the X-altitude or the X-median intercepts the central axis (Z) of the nozzle through bore at the through bore centre;

(d) all the angles of the triangle are acute;

(e) the triangle is isosceles;

(f) a triangle according to (c) wherein the angle, $2\alpha$, formed by the through bore centre and the two vertices of the triangle other than the X-vertex is comprised between 60 and 90°;

(g) a triangle wherein the angle formed by the X-vertex is smaller than 60°.

3. Inner nozzle according to claim 1, comprising a gas connection element in fluid communication with the casting through bore and/or with a groove lying on the contact surface of the inner nozzle, said gas connection element being arranged between two bearing ledges.

4. Metallic casing for cladding an inner nozzle according to claim 1, said metal casing comprising a main surface with an opening for accommodating the nozzle's tubular portion and side edges extending from the perimeter of the main surface, wherein said metallic casing comprises three separate bearing elements jutting out of said side edges, each bearing element comprising a bearing ledge being oriented away from said main surface, and being arranged around the periphery of the metal casing such that the centroids of each of said three bearing elements form the vertices of a triangle.

5. Metallic casing according to claim 4, wherein the positions of the three bearing ledges is defined by at least one geometry selected from the group consisting of:

(a) a first altitude of the triangle, referred to as X-altitude, passing through a first vertex, referred to as X-vertex, is substantially parallel to a first axis (X)

(b) a first median of the triangle referred to as X-median, passing through the X vertex, is substantially parallel to said first axis (X)

(c) a triangle such that either the X-altitude or the X-median intercepts the central axis (Z) of the nozzle through bore at the through bore centre;

(d) all the angles of the triangle are acute;

(e) the triangle is isosceles, such that the X-vertex is the meeting point of the two sides of equal length;

(f) a triangle according to (c) wherein the angle, $2\alpha$, formed by the through bore centre and the two vertices of the triangle other than the X-vertex is comprised between 60 and 90°;

(g) a triangle wherein the angle formed by the X-vertex is smaller than 60°;

and wherein the metallic casing is clad onto an inner nozzle.

* * * * *